US009828956B2

(12) United States Patent
Leblon et al.

(10) Patent No.: US 9,828,956 B2
(45) Date of Patent: Nov. 28, 2017

(54) METHOD FOR CONTROLLING A PIEZOELECTRIC FUEL INJECTOR OF AN INTERNAL COMBUSTION ENGINE OF A VEHICLE COMPRISING A STEP FOR POLARIZING THE PIEZOELECTRIC ACTUATOR

(71) Applicants: CONTINENTAL AUTOMOTIVE FRANCE, Toulouse (FR); CONTINENTAL AUTOMOTIVE GMBH, Hannover (DE)

(72) Inventors: Michael Leblon, Bressols (FR); Jeremie Memain, Lagrace Dieu (FR)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 105 days.

(21) Appl. No.: 14/764,587

(22) PCT Filed: Feb. 25, 2014

(86) PCT No.: PCT/EP2014/000488
§ 371 (c)(1),
(2) Date: Jul. 30, 2015

(87) PCT Pub. No.: WO2014/131508
PCT Pub. Date: Sep. 4, 2014

(65) Prior Publication Data

US 2015/0369187 A1 Dec. 24, 2015

(30) Foreign Application Priority Data

Feb. 26, 2013 (FR) ..... 13 51678

(51) Int. Cl.
*F02D 41/00* (2006.01)
*F02M 51/06* (2006.01)
(Continued)

(52) U.S. Cl.
CPC ..... *F02M 51/0603* (2013.01); *F02D 41/2096* (2013.01); *F02D 41/2467* (2013.01);
(Continued)

(58) Field of Classification Search
CPC ..... F02M 51/0603; F02D 2041/2055
See application file for complete search history.

(56) References Cited

U.S. PATENT DOCUMENTS 5,778,852 A * 7/1998 Penteker ..... F02D 41/22 123/359
6,053,150 A * 4/2000 Takahashi ..... F02D 41/2438 123/300
(Continued)

FOREIGN PATENT DOCUMENTS

CN 102102609 6/2011
DE 10331057 2/2005
(Continued)

OTHER PUBLICATIONS

International Search Report, dated Apr. 11, 2014, from corresponding PCT application.

*Primary Examiner* — Hieu T Vo
*Assistant Examiner* — Sherman Manley
(74) *Attorney, Agent, or Firm* — Young & Thompson

(57) ABSTRACT

Method for controlling a fuel injector with a piezoelectric actuator acting on a valve element, including the following steps, in the normal operation of the vehicle:

(200): Estimating an engine parameter ($Pj_{EST}$), representative of an actual play ($J_{REEL}$) between the piezoelectric actuator and the valve element, (Continued)

(300): Comparing the engine parameter with the equivalent parameter ($Pj_{ECU}$) representative of the original play ($J_{INIT}$): if the engine parameter differs from the equivalent parameter in such a way that the actual play is greater than the original play:

Applying an electrical polarization charge to the piezoelectric actuator, in order to polarize the piezoelectric actuator during the injection of the fuel, Commanding the closure of the injector.

16 Claims, 4 Drawing Sheets

(51) Int. Cl.
*F02D 41/20* (2006.01)
*F02D 41/24* (2006.01)

(52) U.S. Cl.
CPC ..... *F02D 2041/2051* (2013.01); *F02D 2041/2055* (2013.01)

(56) References Cited

U.S. PATENT DOCUMENTS 6,142,121 A * 11/2000 Nishimura ..... F02D 41/008 123/447
6,276,337 B1 * 8/2001 Minato ..... F02D 41/20 123/456
6,820,474 B2 * 11/2004 Rueger ..... F02D 41/2096 73/114.45
6,849,988 B2 * 2/2005 Rueger ..... F02D 41/2096 310/316.03
6,863,055 B2 * 3/2005 Rueger ..... F02D 41/2096 123/478
6,973,919 B2 * 12/2005 Joos ..... F02D 41/2096 123/478
2003/0164166 A1 * 9/2003 Takeuchi ..... F02D 41/0085 123/674
2005/0126534 A1 * 6/2005 Kikutani ..... F02D 41/20 123/299
2005/0247285 A1 * 11/2005 Nagai ..... F02D 35/023 123/305
2005/0257777 A1 * 11/2005 Ishizuka ..... F02D 41/20 123/480
2006/0005816 A1 * 1/2006 Ishizuka ..... F02D 41/1401 123/467
2006/0012265 A1 1/2006 Bachmaier et al.
2007/0175446 A1 * 8/2007 Ishizuka ..... F02D 35/023 123/435
2008/0265715 A1 10/2008 Dollgast et al.
2010/0288238 A1 * 11/2010 Beilharz ..... F02D 41/2096 123/480
2015/0096539 A1 4/2015 Leblon et al.
2015/0108923 A1 4/2015 Leblon et al.

FOREIGN PATENT DOCUMENTS

| | | |
|---|---|---|
| DE | 10340975 | 3/2005 |
| DE | 102004018211 | 11/2005 |
| DE | 102004021955 | 12/2005 |
| DE | 102004046080 | 4/2006 |
| DE | 102007047657 | 4/2009 |
| DE | 102007059111 | 6/2009 |
| DE | 102010021448 | 12/2011 |
| EP | 1138910 | 10/2001 |
| EP | 1179129 | 2/2002 |
| EP | 1445459 | 8/2004 |
| FR | 1254719 | 2/1961 |
| FR | 2919972 | 2/2009 |
| FR | 2990998 | 11/2013 |
| GB | 2451754 | 2/2009 |
| WO | 2004001794 | 12/2003 |
| WO | 2004040112 | 5/2004 |
| WO | 2005081332 | 9/2005 |
| WO | 2010097330 | 9/2010 |

* cited by examiner

METHOD FOR CONTROLLING A PIEZOELECTRIC FUEL INJECTOR OF AN INTERNAL COMBUSTION ENGINE OF A VEHICLE COMPRISING A STEP FOR POLARIZING THE PIEZOELECTRIC ACTUATOR

BACKGROUND OF THE INVENTION

Field of the Invention

The invention relates to a method for controlling a fuel injector of an internal combustion engine of a vehicle, the injector comprising a piezoelectric actuator acting on a valve means to open or close the injector, thereby respectively allowing or stopping the injection of fuel into a combustion chamber of the engine, said vehicle comprising an on-board engine control unit for executing said control method.

Description of the Related Art

A piezoelectric actuator is mainly composed, in a known way, of a stack of ceramic elements defining a specified length, which has the property of having its length modified by the action of an electric field, and, conversely, of producing an electric field under the action of a mechanical stress; this stack is placed in an injector between a stop and the valve means, and operates, in summary, in the following manner: when an electrical charge is applied, by means of a voltage, to the piezoelectric actuator, its length increases and opens the valve means of the injector which thus releases fuel under pressure into the combustion chamber. More precisely, in an injection system having a high pressure common injection rail, and as a general rule, the valve means comprises a poppet actuated directly by the piezoelectric actuator, and an associated needle actuated by its contact with the high pressure in the rail, made possible by the movement of the poppet toward its open position under the action of the piezoelectric actuator. This is because the poppet, when opened, allows the high pressure from the injection rail to be put into communication with the low pressure of the return circuit to the fuel tank, thus changing the balance of forces at the terminals of the injector needle, enabling the latter to move upwards. As a result of this upward movement, the needle frees the openings of the injector jet, enabling fuel to be injected into the combustion chamber under the action of the high pressure from the rail. At rest, that is to say in a closed position of the valve means (with the poppet and needle closed), there is play between the piezoelectric actuator and the valve means, or more precisely between the piezoelectric actuator and the poppet, in order to enable this valve means to be closed and prevent uncontrolled leaks of fuel toward the combustion chamber. This play will be referred to in the rest of the present description either by its full name or by the abbreviated name of "actuator play".

In order to be stable and have reproducible behavior, a piezoelectric actuator must be polarized at a reference value, this being done in the factory during the manufacture of said actuator, and before the engine is put into use in a vehicle. This polarization, called the initial polarization, consists in applying an electrical charge by means of a specified voltage, called the polarization voltage, for a period which is also specified, across the terminals of the piezoelectric actuator, thereby causing the crystal structure of the latter to be orientated in the direction of the electric field established in the piezoelectric stack, corresponding to the direction in which the variation of the dimension of the piezoelectric actuator is desired. After the removal of this initial polarization voltage at the terminals of the piezoelectric stack, this stack retains a residual polarization state for its subsequent use.

However, a piezoelectric actuator tends to lose this initial polarization during its use in an internal combustion engine, notably because of the essentially urban use of the vehicle, resulting in low engine speeds and therefore low nominal voltages, considerably less than the polarization voltage, for commanding the injectors under low fuel pressure. In fact, the nominal supply or command voltage applied to a piezoelectric actuator to open an injector is adjusted as a function of the requested torque and the engine speed. In particular, it is adjusted, where appropriate, as a function of the fuel pressure which is opposed to the opening of the valve means of the injector, and more generally to the energy required to open the valve means of the injector. This adjustment of the electrical charge supplied to the piezoelectric actuator, by means of the voltage for example, is thus optimized, notably, on the basis of the resistive force opposed by the fuel pressure, thereby avoiding, or tending to reduce, rattling of the injector caused by the application of a valve means opening force which is much greater than this resistive force.

It should be noted that injectors, notably for internal combustion engines running on diesel fuel at high pressure, are preferably designed so that the fuel pressure is used in such a way that it is applied, in the closed position of the injector, from the side of the valve means which keeps the latter in a position in which it bears on its seat. Additionally, the electrical charge required for the injector opening operation may be adjusted, preventing the noise generated by this opening of the injectors from being audible above the general engine noise; that is to say, a map of the nominal opening voltages of the injectors is drawn up in the factory on the basis of the engine parameters.

Other conditions of use, such as repeated cycles of increase and/or decrease in the engine temperature, or long periods without the use of the piezoelectric actuator, corresponding to prolonged periods of immobilization of the vehicle, may also lead to a change in the initial polarization of the piezoelectric actuator over time.

The depolarization, or drift, causes a contraction of the stack of ceramic elements of the piezoelectric actuator, and a consequent increase in the play between the piezoelectric actuator and the valve means. The increase in this play results in a less precise control of the actuator, or drift, which may even lead to the loss of one or more injections of small amounts of fuel, for example what are known as pilot injections, since the injector no longer has time to compensate for the clearance and open the valve for small time intervals, causing increased engine noise in the form of knocking (the main injection combustion takes place with a high pressure gradient owing to the lack of a pilot injection) and pollution, as well as making driving disagreeable. For longer periods of opening of the injector, the drift of the piezoelectric actuator leads to poor control of the amount of fuel actually injected into the combustion chamber.

The known document DE 10 2010 021448 A1 relates to a method of regulating the polarization of a piezoelectric actuator of an injector. In this document, with the aim of improving the control of the quantity of fuel injected, an output signal is superimposed on an offset voltage of the piezoelectric actuator, this offset voltage not opening the injector in any circumstances.

In French Patent Application FR 1254719, filed on 23 May 2012, not published at the date of filing of the present patent application, the applicant proposed a solution to overcome the above drawbacks. This solution consists in a method for controlling at least one piezoelectric actuator of a fuel injector of an internal combustion engine of a vehicle, said at least one piezoelectric actuator acting on a valve means to open or close said injector, thereby respectively enabling or preventing the injection of fuel into a combustion chamber of the engine, comprising the following steps:

applying a first nominal electrical charge to the piezoelectric actuator, this charge being required to open the injector, and being referred to as the nominal command charge, on the basis of the torque requested and the engine speed, in order to open the valve means of the injector to inject fuel into the combustion chamber, commanding the closure of the injector so as to stop the fuel injection, by applying an electrical discharge to the piezoelectric actuator in order to close the valve means, said control method being applied from an engine control unit located on board the vehicle in operation, and further comprising a step of applying to the piezoelectric actuator on top of said nominal command charge, after the application of the latter and before the step of commanding a closure of the injector, at least a second electrical charge, called the polarization charge, which is additional to said nominal command charge, in order to polarize the piezoelectric actuator during an opening phase of the injector and during the injection of the fuel into the combustion chamber.

Using this method it is possible, notably, to maintain the polarization of an actuator regardless of the use of the vehicle, since this actuator is polarized during the operation of the vehicle. One result of the application of this method for controlling a piezoelectric actuator of an injector is that excessive polarization of the piezoelectric actuator may occur, exceeding the reference or initial polarization provided in the factory during the manufacture of the injector. The main drawback of this is that it may even cause the elimination of the play between the piezoelectric actuator and the valve means which enable the valve means to be closed, and may therefore make it impossible to close the valve means of the injector by increasing the resting length of the actuator taking up said play, consequently giving rise to leaks of fuel into the combustion chamber. This is because the initial polarization of an actuator (the factory polarization) is carried out according to a predetermined polarization protocol established on the basis of the actuator itself and the voltages and/or currents available for the control of the actuator by the engine control unit. This factory polarization is not necessarily maximal for any given actuator.

BRIEF SUMMARY OF THE INVENTION

The essential aim of the present invention is to overcome this drawback. More precisely, it consists in a method for controlling a fuel injector of an internal combustion engine of a vehicle, said injector comprising a piezoelectric actuator acting on a valve means to open or close said injector, thereby respectively enabling or preventing the injection of fuel into a combustion chamber of the engine, said vehicle comprising an on-board engine control unit for executing said control method, said valve means comprising a poppet actuated directly by the piezoelectric actuator and an associated needle actuated by its contact with the high pressure in the rail, said poppet, when open, allowing the high pressure from an injection rail to communicate with the low pressure of the return circuit leading to the fuel tank, said control method being characterized in that it comprises the following steps, in the normal operation of the vehicle:

Estimating a first engine parameter, representative of an actual play between the piezoelectric actuator and the valve means, Comparing said estimated first engine parameter with the equivalent parameter representative of the original play between the piezoelectric actuator and the valve means, as previously recorded in the engine control unit, If said estimated first engine parameter differs from said equivalent parameter representative of said original play in such a way that said actual play is greater than said original play:

Applying a first nominal electrical charge to the piezoelectric actuator, this charge being required to open the injector, and being referred to as the nominal command charge, on the basis of the torque requested and the engine speed, in order to open the valve means of the injector to inject fuel into the combustion chamber, Applying to the piezoelectric actuator, on top of said nominal command charge, after the application of the latter and before the step of commanding a closure of the injector, at least a second electrical charge, or polarization charge, which is additional to the nominal command charge, in order to polarize the piezoelectric actuator during an opening phase of the injector and during the injection of the fuel into the combustion chamber, Commanding the closure of the injector so as to stop the fuel injection, by applying at least one electrical discharge to the piezoelectric actuator in order to close the valve means, If said estimated first engine parameter differs from said equivalent parameter representative of said original play in such a way that said actual play is smaller than or equal to said original play, not applying said second electrical charge, called the polarization charge, to the piezoelectric actuator of said injector.

The method according to the invention makes it possible to evaluate the requirement for polarization of the piezoelectric actuator on the basis of an evaluation of the drift of the injector, by means of an evaluation of the play of the actuator, by comparison with the corresponding original or initial play of the actuator established in the factory or the manufacturer's initial play, thereby avoiding any excessive polarization of the actuator. The method may be applied in a loop by the engine control unit in order to provide monitoring of the polarization charge applied during the opening of the injector, thus ensuring that the initial characteristics of the injector are maintained. The method may also advantageously be used for contributing to a certain extent to the correction of the wear of the injector, by making the application of the polarization charge dependent on the maintenance of the initial injector map, possibly resulting in a change in the initial length of the piezoelectric actuator to compensate for the mechanical wear of the injector components.

According to an advantageous characteristic, said estimated first engine parameter representative of an actual play between the piezoelectric actuator and the valve means is a measured duration of application time of a weak electrical pulse to the piezoelectric actuator, this pulse corresponding to a specified test variation in the pressure of the fuel contained in a common injection rail of said engine, for a predetermined reference duration of electrical activation of the injector.

The application time of an electrical pulse to the piezoelectric actuator is defined as the time required to apply a given electrical charge at a given current level to the piezoelectric actuator. This characteristic offers the choice of the measurement of this time of application to the piezoelectric actuator of a weak electrical pulse causing a specified pressure variation of the common injection rail corresponding to a predetermined reference duration of electrical activation of the injector as a representative engine parameter for the purpose of monitoring the activation of the polarization charge during the opening of the injector. The expression "duration of electrical activation of the injector" is taken to mean, essentially, the duration of the maintenance of the electrical charge at the terminals of the piezoelectric actuator. The rail pressure drop is very sensitive to the activation of the valve means of an injector, and more precisely to the activation of the injector poppet. This monitor of the state of the actuator play may advantageously be provided virtually constantly while the vehicle is in operation, except during the actual phases of fuel injection into the combustion chamber. This test may be carried out, for example, in an engine cycle after the compression top dead center, during the expansion phase of the engine.

According to an advantageous characteristic of the above, the step of measuring the duration of the application time of a weak electrical pulse to the piezoelectric actuator, this pulse corresponding to a specified test variation in the pressure of the fuel contained in a common injection rail of said engine, for a predetermined reference period of electrical activation of the injector, comprises the following steps:

- Choosing a test pressure variation of the fuel contained in a common injection rail of the engine, corresponding to a specified duration of an application time of a specified electric current at the terminals of the piezoelectric actuator to provide a weak test charge at the terminals of the actuator, defining the predetermined reference duration of electrical activation of the injector, in such a way that a fuel leak is established from the common rail through the injector toward the tank return line without the opening of the injector needle,
- Applying a weak electrical charge to the terminals of the piezoelectric actuator, in such a way that a fuel leak is established from the common rail through the injector toward the tank return line without the opening of the injector needle,
- Maintaining this charge during said duration of electrical activation so as to obtain a measurement of the pressure variation in the common injection rail,
- Comparing said measurement of the pressure variation obtained with said chosen test pressure variation of the fuel contained in a common injection rail,
- Repeating the preceding three steps while modifying the time of application of an electrical pulse to the piezoelectric actuator, until said measured pressure variation is equal to said test pressure variation, and measuring the duration of the time of application of an electrical pulse to the piezoelectric actuator for which the measured pressure variation is equal to the test pressure variation.

This characteristic consists in conducting a test on the injector consisting in applying a weak electrical charge to the piezoelectric actuator and maintaining it for a certain period, then discharging this electrical charge without the injection of fuel into the combustion chamber, that is to say without the opening of the injector needle. Essentially, the procedure is one of applying a low-intensity electrical pulse to the piezoelectric actuator, leading to the application of a low voltage to the terminals of the piezoelectric actuator resulting in a small elongation of the latter, causing a small movement of the poppet in its opening direction, in such a way that a flow of fuel passes through the injector toward the circuit for returning the fuel to the tank, without the injector needle having time to start moving in the direction of the opening of the injection nozzle as a result of being brought into contact with the high pressure triggered by the opening of the poppet. This electrical charge then has to be discharged so as to reclose the poppet after a specified period of activation of the injector, corresponding to a given pressure drop. This test advantageously makes it possible to evaluate the drift of the injector which practically corresponds to the drift of the actual play between the piezoelectric actuator and the valve means of the injector relative to the initial play, by comparing the duration of the measured electrical charge for obtaining the chosen (test) variation of pressure of the fuel in the common rail, for a predetermined reference duration of electrical activation of the injector, with the duration of the electrical charge recorded in the engine control unit for the same test variation of pressure in the rail based on a test pulse applied to the injector in its initial, or factory-new, condition. In fact, this measurement, made without opening the injector and therefore without any needle movement, is based on very few moving parts (the poppet), and the drift that is found is entirely, or practically entirely, attributable to said play of the actuator. If the duration of the charge measured at the terminals of the piezoelectric actuator is greater than the predicted or recorded duration, for a given test variation of pressure in the rail, this means that the play between the piezoelectric actuator and the valve means has increased, because it takes longer to discharge the same quantity of fuel from the rail. Conversely, if the duration of the measured charge is shorter than the predicted or recorded duration, for a given test variation of pressure in the rail, this means that the play between the piezoelectric actuator and the valve means has decreased, because less time is required to discharge the same quantity of fuel from the rail. This is because the time required for the piezoelectric actuator to take up the play during the application of a current pulse for a specified duration to its terminals is deducted from the time for the passage of the fuel through the injector with the poppet open; the quantity of fuel passing through the injector during a current pulse, and consequently the fuel pressure in the common rail, is therefore a direct function of the play between the piezoelectric actuator and the valve means of the injector.

According to an advantageous alternative characteristic, said estimated first engine parameter representative of an actual play between the piezoelectric actuator and the valve means is a test quantity of fuel actually injected by the injector into the combustion chamber in response to a command for the injection of a test quantity of fuel, predetermined by the engine control unit, into said combustion chamber.

This characteristic offers the choice of an estimated first engine parameter, containing information representative of the play of the piezoelectric actuator in the form of a test quantity of fuel injected into the combustion chamber, evaluated on the basis of a second engine parameter measured in relation to this quantity, by comparison with the commanded test quantity of fuel predetermined by the engine control unit.

According to an advantageous characteristic of the above, the step of estimating said test quantity of fuel actually injected by the injector into the combustion chamber comprises the following steps:

Commanding the injection of said test quantity of fuel, predetermined by the engine control unit, into said combustion chamber, in order to monitor the actual test quantity of fuel injected in response to said command, Measuring a second engine parameter, representative of the actual test quantity of fuel injected in response to said command for the injection of said predetermined test quantity of fuel, Determining, on the basis of said measured second parameter, said actual test quantity of fuel injected in response to said command for the injection of said predetermined test quantity of fuel.

According to an advantageous characteristic of the above, said step of measuring a second engine parameter, representative of the actual test quantity of fuel injected in response to said command for the injection of a test quantity of fuel predetermined by the engine control unit, consists in measuring the engine speed before and after the injection of the actual test quantity of fuel injected in response to said command for the injection of a test quantity of fuel predetermined by the engine control unit, to obtain the variation of engine speed or engine torque resulting from the injection of the actual quantity of fuel.

This characteristic offers the choice of the engine speed for finding the acceleration of the engine crankshaft or the engine torque, as the second representative engine parameter for the purpose of monitoring the activation of the polarization charge during the opening of the injector. The acceleration of the crankshaft or the variation of engine torque may advantageously be determined in a known way by means of the crankshaft position sensor, already installed in the engine to permit the operation of the engine control unit, which requires, notably, a knowledge of the angular position of the crankshaft and of the time elapsing between two specified positions of the crankshaft. The predetermined test quantity of fuel may preferably be injected around the compression top dead center, during the combustion expansion phase.

According to an advantageous characteristic, said quantity of fuel predetermined by the engine control unit, the injection of which into said combustion chamber is commanded for the purpose of monitoring the actual quantity of fuel injected, is defined on the basis of a correspondence table between the periods of maintenance of electrical charges applied to the injector and the corresponding quantities of fuel injected, as a function of a range of fuel pressure in a common injection rail.

According to an advantageous characteristic, the step of comparing the actual test quantity of fuel injected with the test quantity of fuel predetermined by the engine control unit comprises the application of a correction factor.

BRIEF DESCRIPTION OF THE DRAWINGS

The invention will be more readily understood and other characteristics will become apparent from the following description of two examples of embodiment of a method of monitoring a fuel injector according to the invention, accompanied by the attached drawings, these examples being non-limiting and provided for illustrative purposes.

DETAILED DESCRIPTION OF THE PREFERRED EMBODIMENTS

Figure 1:
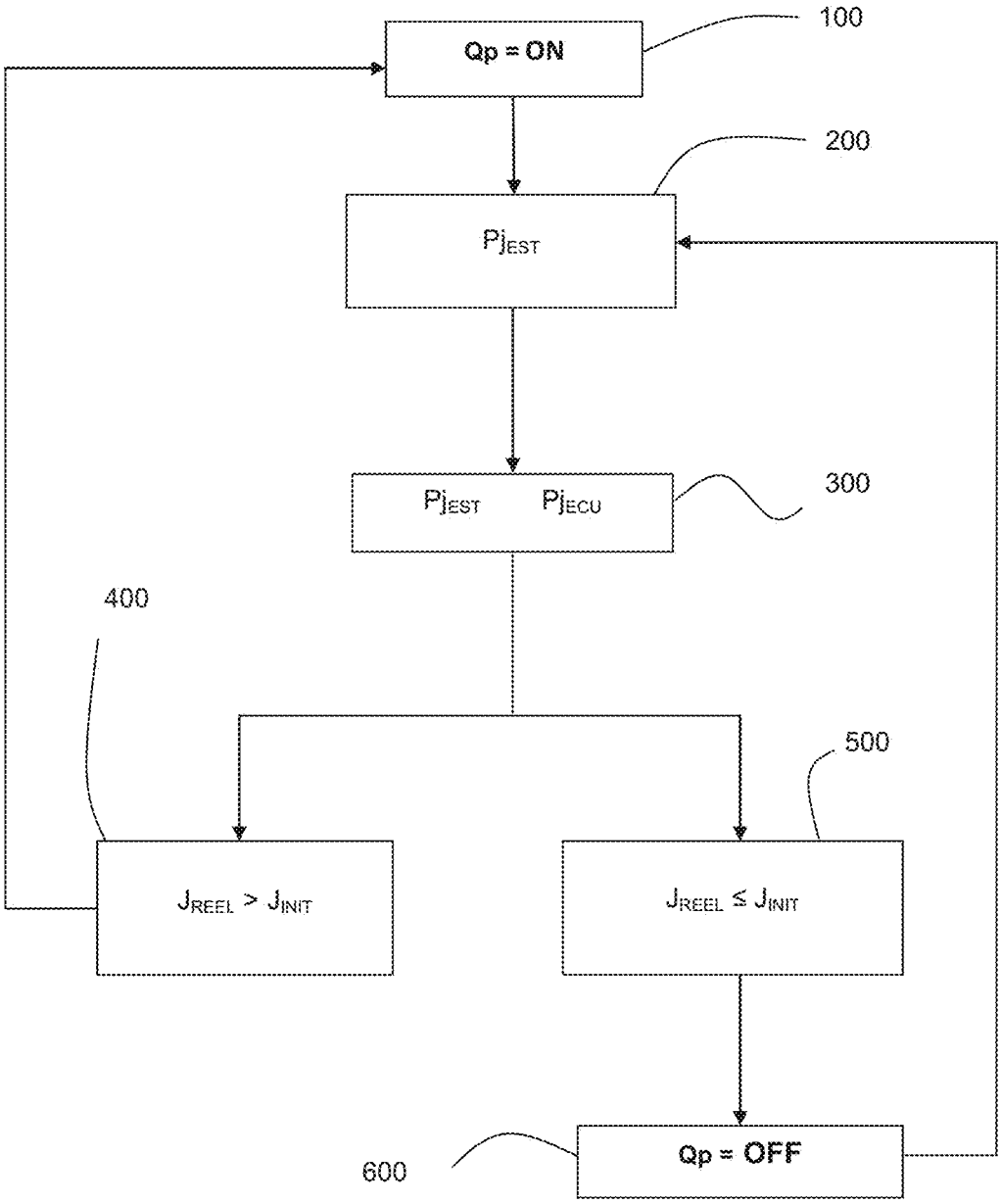
FIG. 1 shows a flow diagram of an exemplary embodiment of the method for controlling a fuel injector according to the invention.

The flow diagram shown in FIG. 1 relates to a method for controlling a fuel injector of an internal combustion engine of a vehicle (the engine and vehicle are not shown), the injector comprising, in a known way, a piezoelectric actuator acting on a valve means to open or close the injector, thereby respectively enabling or preventing the injection of fuel into a combustion chamber of the engine. The vehicle comprises, in a known way, an on-board engine control unit (abbreviated in English to ECU) (not shown), which is used for executing the control method according to the invention which is described, by means of the implementation of software for executing the control method.

As shown in FIG. 1, the method comprises the following steps, during the normal operation of the vehicle, with the engine running and the vehicle moving or stationary:

Step 100: Activating the polarization charge of the piezoelectric actuator as soon as the engine of the vehicle is started, Step 200: Estimating a first engine parameter $Pj_{EST}$, representative of an actual play $J_{REEL}$ between the piezoelectric actuator and the valve means, Step 300: Comparing the estimated first engine parameter $Pj_{EST}$ with the equivalent parameter $Pj_{ECU}$, representative of the original or initial play $J_{INIT}$ between the piezoelectric actuator and the valve means, as previously recorded in the engine control unit:

Step 400: If the estimated first engine parameter $Pj_{EST}$ differs from the equivalent parameter $Pj_{ECU}$, representative of the equivalent original play $J_{INIT}$, in such a way that the actual play $J_{REEL}$ of the actuator is greater than its original play $J_{INIT}$, then, as shown in FIGS. 4*a* and 4*b*:

Applying a first nominal electrical charge Qc to the piezoelectric actuator, this charge being required to open the injector, and being referred to as the nominal command charge Qc, on the basis of the torque requested and the engine speed, in order to open the valve means of the injector to inject fuel into the combustion chamber, Applying to the piezoelectric actuator, on top of said nominal command charge Qc, after the application of the latter and before the step of commanding a closure of the injector, at least a second electrical charge, or polarization charge, Qp, which is additional to the nominal command charge Qc, in order to polarize the piezoelectric actuator during an opening phase of the injector and during the injection of the fuel into the combustion chamber, Commanding the closure of the injector so as to stop the fuel injection, by applying at least one electrical discharge Qd to the piezoelectric actuator in order to close the valve means, Step 500: If the estimated first engine parameter $Pj_{EST}$ differs from the equivalent parameter $Pj_{ECU}$ representative of the equivalent original play $J_{INIT}$ of the actuator in such a way that the actual play $J_{REEL}$ of the actuator is less than or equal to its original play $J_{INIT}$, not applying the second electrical charge Qp, called the polarization charge, to the piezoelectric actuator of the injector, according to step 600 of FIG. 1.

The step 100 of activating the polarization charge of the piezoelectric actuator, advantageously as soon as the engine of the vehicle is started, is described more fully below with the aid of FIGS. 4*a* and 4*b*, for example on each main injection by default.

Figure 4A:
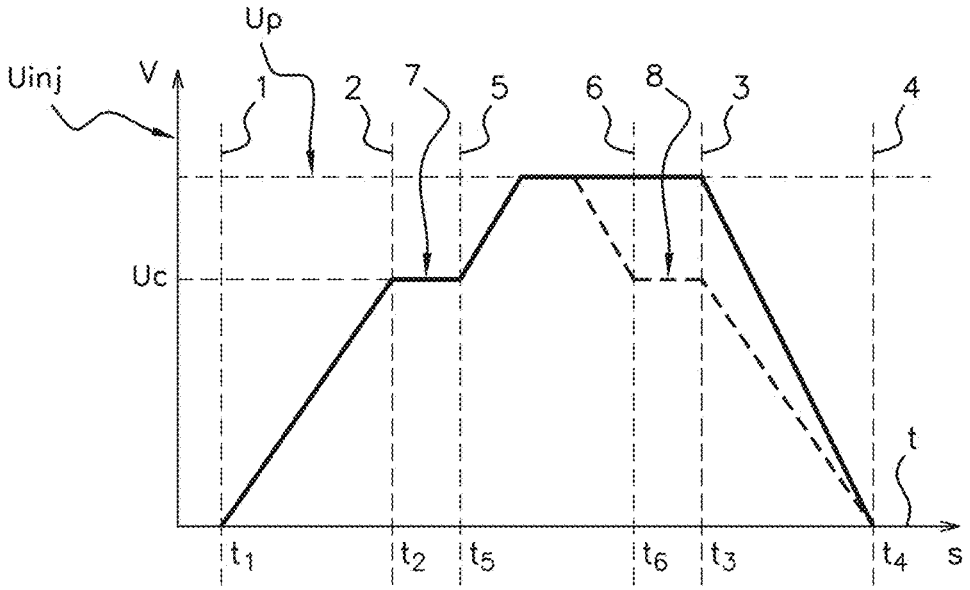
FIG. 4*a* shows two synchronized schematic diagrams of the profile of the voltage at the terminals of a piezoelectric actuator as a function of time during the opening of the injector, following a first (broken lines) and a second (continuous lines) example of modes of applying a polarization charge to a piezoelectric actuator.
Figure 4B:
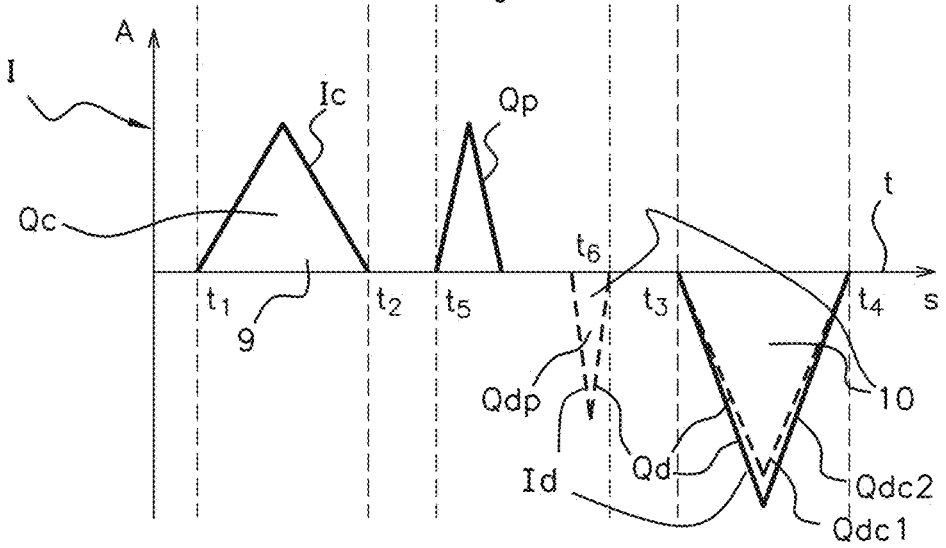
FIG. 4*b* shows two schematic diagrams, synchronized with FIG. 4*a*, of a first (broken lines) and a second (continuous lines) profile of the charging/discharging current flowing through the piezoelectric actuator as a function of time, corresponding, respectively, to the first and second examples of voltage profiles of FIG. 4*a*.

FIGS. 4*a* and 4*b* relate to schematic diagrams of an example of the control of an injector with a piezoelectric actuator, for which the diagram of FIG. 4*a* is an example of a profile of the voltage applied to the terminals of the piezoelectric actuator as a function of time during the opening of the injector, and the diagram of FIG. 4*b* shows an example of a profile of the strength of the charging current applied to the piezoelectric actuator as a function of time. The time scale in the two diagrams is shown in a synchronized manner: for example, the four vertical broken lines 1, 2, 3, 4 drawn across both of FIGS. 4*a* and 4*b* correspond to four different instants $t_1$, $t_2$, $t_3$, $t_4$ on the time scale respectively, each of these four instants $t_1$, $t_2$, $t_3$, $t_4$ being the same for both diagrams.

In FIG. 4*a*, it can be seen that the applied charging voltage Uinj, shown on the vertical axis, has, for example, a constant and continuous gradient from the instant $t_1$, corresponding to the command for opening the injector, to the instant $t_2$, corresponding to a nominal command voltage level Uc of the piezoelectric actuator applied in order to open the injector, that is to say in order to elongate or expand the piezoelectric actuator; this nominal voltage level Uc is predetermined by a known injection map of the engine (not shown), and corresponds to the minimum voltage required to obtain an opening of the injector which, notably, creates minimum noise, and is suitable for a requested engine torque and an engine speed. The nominal voltage Uc shown in FIG. 4*a* is less than a polarization voltage value Up of the piezoelectric actuator. The voltage Uinj applied to the piezoelectric actuator is then kept constant at the level of the nominal voltage Uc. Since it is used below its resonance frequency, the piezoelectric element acts as a capacitive element, and retains the voltage Uc applied to its terminals. In the absence (not shown) of a polarization charge at the voltage level Up, this nominal voltage Uc would be kept constant up to the instant $t_3$ corresponding to the valve means closure command, which is shown on the horizontal axis t corresponding to the time scale, that is to say during a minimum time $t_3-t_2$ for the complete opening of the valve means. Then, from the instant $t_3$, the voltage Uinj decreases to the instant $t_4$ for closing the injector, as a result of one or more electrical discharges of the piezoelectric actuator which thus returns to its initial contracted length corresponding to the closure of the injector. The electrical discharge or discharges may be provided, for example, by one or more short-circuitings of the terminals of the piezoelectric actuator.

FIG. 4*b* shows schematically, on the vertical axis I corresponding to the charging/discharging current flowing through the piezoelectric actuator, a first curve of charging current strength Ic, between the instants $t_1$ and $t_2$, corresponding to the application of the nominal voltage Uc for opening the injector by increasing the length of the actuator, and a second curve of discharging current strength Id for closing the injector, corresponding to the fall in the voltage Uinj to the instant $t_4$ resulting from one or more electrical discharges of the piezoelectric actuator, for example by means of one or more short-circuitings of the terminals of the actuator, to obtain a rapid contraction of the piezoelectric actuator and consequently the closure of the injector. The electrical charge Qc applied to the piezoelectric actuator for opening the injector may be calculated in a known way on the basis of the area 9 in FIG. 4*b*, defined between the charging current pulse curve Ic and the horizontal axis t; the same procedure may be used with the electrical discharge or discharges Qd applied to the piezoelectric actuator for closing the injector, on the basis of the area 10 in FIG. 4*b*, which is defined between the discharging current pulse curve Id and the horizontal axis t for closing the injector, and which is, for example, substantially at least equal to −(Qc+Qp) to ensure the closure of the injector.

In FIGS. 4*a* and 4*b*, two vertical broken lines 5 and 6 have been added, these lines being drawn across both FIGS. 4*a* and 4*b*, and corresponding, respectively, to two different instants $t_5$ and $t_6$ on the time scale t, each of these two instants $t_5$ and $t_6$ being the same for both diagrams 4*a* and 4*b*, the instants $t_5$ and $t_6$ lying between the instants $t_2$ and $t_3$ as explained in detail below.

The electronic control system for a piezoelectric actuator is known to those skilled in the art and will not be detailed further here. For the application of the method for controlling the piezoelectric actuator or the injector according to FIGS. 4*a* and 4*b*, an electronic control system of a known type may be suitable. This method for controlling the piezoelectric actuator or the injector may be executed by means of control software which will be implemented in the engine control unit of the vehicle.

The first example (broken lines) of a method shown schematically in FIGS. 4*a* and 4*b* is an example of a method for controlling at least one piezoelectric actuator of a fuel injector of an internal combustion engine of a vehicle, said at least one piezoelectric actuator acting on a valve means to open or close the injector, thereby respectively enabling or preventing the injection of fuel into a combustion chamber of the engine, as explained in detail above at the start of the present description. It should be noted that only the voltage and charging current strength command signals applied to and passing through the piezoelectric actuator have been shown in the figures, and that the method of controlling a piezoelectric actuator that has been described may be applied to an internal combustion engine of a known type with injectors which are also of a known type, and which, therefore, are not shown.

The control method according to FIGS. 4*a* and 4*b* is applied from an engine control unit ECU (not shown) of a known type, on board the vehicle in operation, and comprises the following steps of:

applying, in a known way, a first nominal electrical charge Qc to the piezoelectric actuator, this charge being required to open the injector, and being referred to as the nominal command charge Qc, between the instants $t_1$ et $t_2$, on the basis of the torque requested and the engine speed, for example according to a conventional voltage gradient predetermined in the engine control unit, in order to open the valve means of the injector to inject fuel into the combustion chamber, as shown in FIG. 4*b*, according to the invention, applying to the piezoelectric actuator, on top of the nominal command charge Qc, starting at an instant $t_5$ later than $t_2$, and therefore after the application of the charge Qc and before the step of commanding a closure of the injector, therefore before the instant $t_3$, a second electrical charge Qp, called the polarization charge, Qp, which is additional to the nominal command charge Qc, in order to polarize the piezoelectric actuator during an opening phase of the injector and during the injection of the fuel into the combustion chamber, as shown in FIG. 4*b*, then commanding the closure of the injector so as to stop the fuel injection, by applying at least one electrical discharge Qd to the piezoelectric actuator, between the instants $t_5$ and $t_4$, as shown in FIG. 4*b*.

As shown in FIG. 4*b*, the polarization charge Qp, defined by a corresponding current profile applied to the piezoelectric actuator, is advantageously decoupled from the nominal command charge Qc, this being manifested in the example by the fact that the end of the command charge Qc and the start of the polarization charge Qp are separated by a non-zero time $t_5-t_2$.

The first Qc and second Qp electrical charges are, for example, obtained by the application of a first Uc and a second Up voltage, called the nominal charging voltage Uc and the polarization voltage Up of the piezoelectric actuator, respectively, the polarization voltage Up being greater than the nominal charging voltage Uc, as shown in FIG. 4*a*.

It should be noted that, in the exemplary embodiments according to FIG. 4*a*, the first Uc and second Up voltages form a plateau 7 in the gradient of the voltage applied to the terminals of the piezoelectric actuator. This voltage plateau 7, representing the delay between the end of the application of the electrical command charge Qc for opening the injector and the start of the application of the polarization charge Qp of the actuator, that is to say a time interval of $t_5-t_2$, may be between 0 (excluded) and a few microseconds, or may form a more pronounced plateau of the order of a number of microseconds, for example 10 to 100 μs, according to the conventional time available for the application of a polarization charge during the opening of the injector, determined by the engine control unit. The minimum time is preferably defined so that the charges Qc and Qp are decoupled, that is to say separated in time.

Additionally, the voltage gradients applied to the terminals of the piezoelectric actuator, between the instants $t_1$ and $t_2$ on the one hand for commanding the opening of the injector, and after the instant $t_2$ on the other hand for polarizing the actuator, are shown in FIG. 4*a* as having the same value or substantially the same value. However, it should be noted that these gradients may differ from one another.

It should be noted that FIGS. 4*a* and 4*b* show, by way of example, a main fuel injection, but it is to be understood that the method according to the invention may be applied to a cycle comprising multiple injections, for example those carried out on more than one occasion, being divided into at least one pilot injection and at least one main injection, in which case the polarization charge Qp or polarization voltage Up is preferably applied during the main injection.

The polarization voltage Up at the terminals of the piezoelectric actuator remains constant because the actuator is used below its resonance frequency, causing it to behave in an equivalent way to a capacitive element. The piezoelectric element then retains the voltage Up applied to its terminals, until the electrical discharge of the actuator for closing the injector, or until the electric discharge of the polarization, that is to say until the instant $t_3$, as detailed below.

According to the first exemplary embodiment shown in broken lines in FIGS. 4*a* and 4*b*, the step of commanding the closure of the injector comprises the application of a first electric discharge Qdp of the piezoelectric actuator, until the nominal command charge Qc of the actuator, or substantially comprises this nominal charge Qc, followed by a second electrical discharge Qdc1 of the actuator, until the closure of the valve means, as shown in the part in broken lines in FIG. 4*b*.

In this first example, the first discharge Qdp is applied before the $t_3$, that is to say before the command for closing the injector, so that the first Qdp and the second Qdc1 electrical discharges of the piezoelectric actuator are decoupled, as shown in FIG. 4*b*. In the example, the decoupling of the discharges Qdp and Qdc1 is manifested by the presence of a non-zero delay between the instant $t_6$, corresponding to the end of the polarization discharge Qdp, and the subsequent instant $t_3$, corresponding to the start of the discharge Qdc1 for closing the injector.

As shown in FIG. 4*a* in broken lines corresponding in a synchronized manner with FIG. 4*b*, the first electrical discharge Qdp of the piezoelectric actuator continuing up to the nominal command charge Qc advantageously consists of a first electrical discharge current, reducing, for example, the voltage across the terminals of the piezoelectric actuator to the nominal charging voltage Uc, the second electrical discharge Qdc1 of the actuator consisting of a second electrical discharge current continuing up to the return of the piezoelectric actuator to its initial length, causing the closure of the injector. The first and second electrical discharge currents Id may, for example, be produced by a first and a second short-circuiting of the terminals of the piezoelectric actuator.

It will be noted, in FIG. 4*a*, in the curve in broken lines of the first example, that the first and second discharge voltages of the piezoelectric actuator form a plateau 8 in the gradient of the discharge voltage applied to the piezoelectric actuator. This voltage plateau 8, representing the delay between the instant $t_6$ of the end of the application of the electrical polarization discharge Qdp of the actuator and the subsequent instant $t_3$ of the start of the application of the command discharge Qdc1, that is to say a time interval of $t_6-t_3$, may be between 0 (excluded) and a few microseconds, or may form a more pronounced plateau of the order of a number of microseconds, for example 10 to 100 μs, according to the conventional time available for the application of the command discharge for closing the injector, determined by the engine control unit which sets the opening delay of the injector. The minimum time is preferably defined so that the electrical discharges Qdp and Qdc1 are decoupled, that is to say separated in time.

Additionally, the voltage drop gradients applied to the piezoelectric actuator in FIG. 4*a* (in broken lines), for the polarization discharge on the one hand (before the instant $t_3$), and for the discharge of the actuator for closing the injector (starting from the instant $t_3$), are shown in FIG. 4*a* as having the same value or substantially the same value. However, it should be noted that these gradients may differ from one another. Furthermore, the discharge gradient or gradients may differ from the charging gradients in absolute value.

FIGS. 4*a* and 4*b* will now be described in relation to the second exemplary embodiment (shown in solid lines).

It should be noted that, in FIGS. 4*a* and 4*b*, this second example exhibits a part in common with the first example described above, comprising the command for the charge Qc for opening the injector and the command for the polarization charge Qp, as shown. The difference lies in a different procedure for controlling the discharge of the piezoelectric actuator for closing the injector, after the application of the polarization charge Qp. More precisely, this difference lies in the absence of a voltage plateau in the discharge of the actuator, due to the fact that an electrical discharge Qdc2 of the actuator in this second example takes place once only after the polarization charge Qp, as shown in FIG. 4*b*. In FIG. 4*a*, it can be seen that the discharge voltage falls between the instants $t_3$ and $t_4$, to reach a zero value at the instant $t_4$, corresponding to the closed position of the injector, with a constant gradient. In this second example, therefore, the first discharge Qdp of the first example is absent, and the only discharge Qdc2 is applied at the instant $t_3$, starting from the polarization voltage Up, and represents the closure of the injector in a single command starting from the polarization voltage Up.

The use of this second embodiment depends on the time available for opening the injector, and, if appropriate, on the acceptable noise level for the closure of the injector. This second embodiment, if applicable, enables the actuator to be kept at the polarization voltage Up for a longer period.

Preferably, the polarization charge is applied constantly and continuously while the engine of the vehicle is running, to ensure that there is a single polarization voltage over the range of torque/rotation speed values of the engine. Alternatively, the polarization charge may be inactivated above a predetermined threshold of torque/rotation speed values of the engine corresponding to command voltages of the piezoelectric actuators close to the polarization voltage.

By way of example, the voltage rise between the charging voltage Uc and the polarization voltage Up may be within the range from 0 (excluded) to 40 volts, reaching a maximum polarization voltage Up of about 140 volts for example, the range of command voltages Uc of the piezoelectric actuator used according to the engine speed and the requested engine torque being substantially within the range from 100 to 140 volts, for example.

The polarization charge as described with the aid of FIGS. 4*a* and 4*b* is, for example, advantageously applied continuously to all the injectors of the vehicle engine, whenever an injector is opened for a main fuel injection, except when the polarization charge is inactivated in the context of the method according to the invention for controlling an injector, as explained below.

Figure 2:
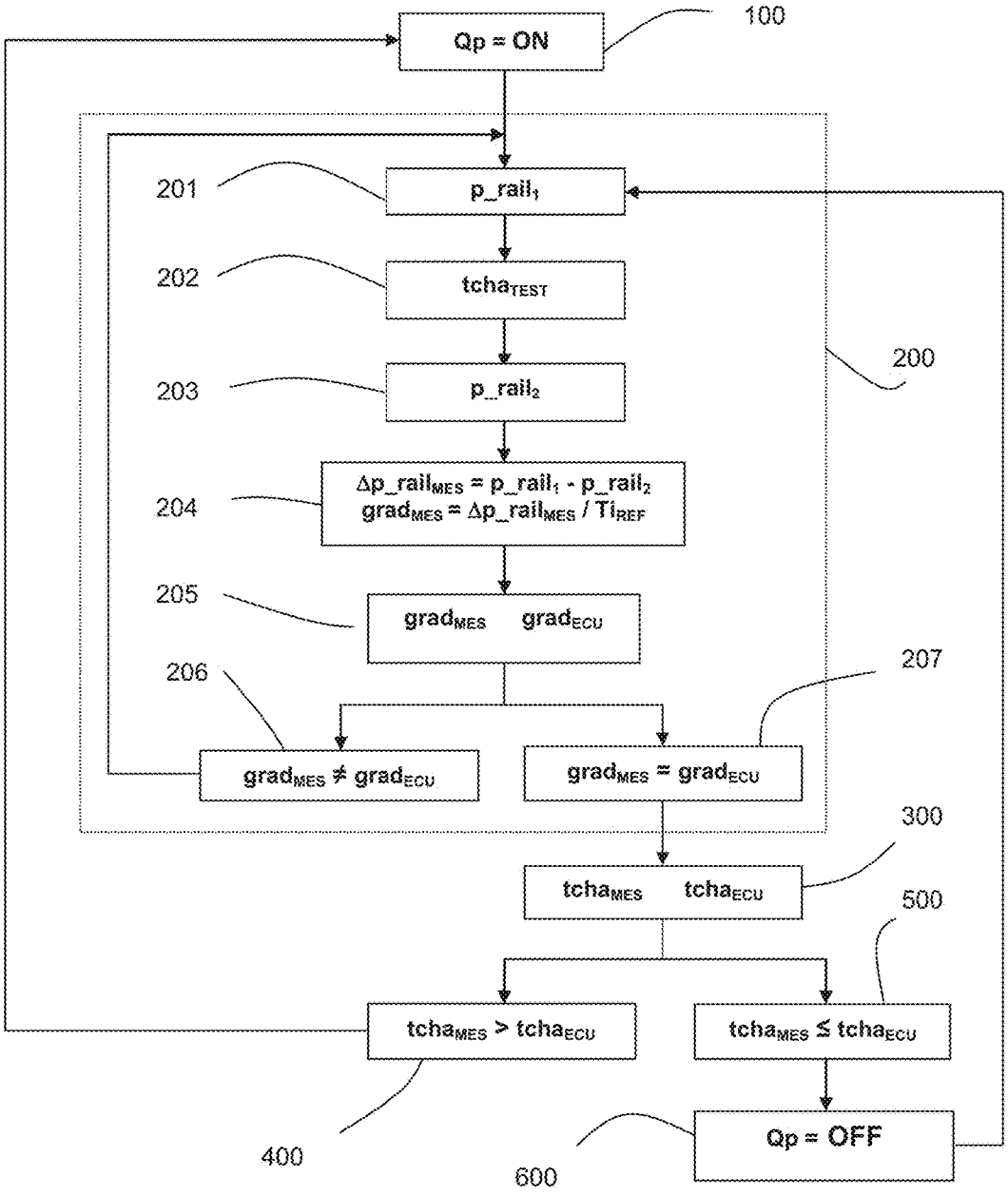
FIG. 2 shows a flow diagram of the method for controlling a fuel injector according to FIG. 1, according to a first example of the engine parameter representative of an actual play between the piezoelectric actuator and the valve means of the injector.

As shown in the example of FIG. 2, at step 200, the estimated first engine parameter $Pj_{EST}$, representative of an actual play $J_{REEL}$ between the piezoelectric actuator and the valve means of an injector, is a measured duration $Tcha_{MES}$ of the application time of a specified electric current, delivered by the engine control unit, at the terminals of the piezoelectric actuator, defining a weak electrical charge corresponding to a specified test variation $\Delta p_rail_{TEST}$ of the pressure of the fuel contained in the common injection rail of the engine, for a predetermined reference duration $Ti_{REF}$ of electrical activation of the injector. It will be recalled that the expression "duration Ti of electrical activation of the injector" is taken to mean, essentially, the duration of the maintenance of the electrical charge at the terminals of the piezoelectric actuator. With reference to FIG. 4, by way of example, the period or duration Tcha corresponds to the duration $t_2-t_1$, and the duration $Ti_{REF}$ substantially corresponds to the duration $t_3-t_1$ or $t_4-t_2$.

A predetermined reference duration $Ti_{REF}$ corresponds to a specified pressure drop $\Delta p_rail_{TEST}$ in the common rail; this specified pressure drop $\Delta p_rail_{TEST}$ is chosen and recorded in the engine control unit for a given type of injector. It is used as a reference for the evaluation of the parameter Tcha.

According to step 200 of FIG. 2, a specified electric current is applied to a piezoelectric actuator, for a given duration of application time Tcha defining a charge applied to this actuator. This charge is maintained for the predetermined duration $Ti_{REF}$, and, after discharging, the pressure drop $\Delta p_rail_{MES}$ is measured in the common rail. As shown in FIG. 2, Tcha is modified in a loop until the pressure drop $\Delta p_rail_{MES}$ in the common rail is equal to the pressure drop $\Delta p_rail_{TEST}$ recorded in the engine control unit. When this pressure drop $\Delta p_rail_{TEST}$ is found, the measured parameter $Tcha_{MES}$ corresponding to the pressure drop $\Delta p_rail_{TEST}$ is recorded.

The parameter $Tcha_{MES}$ corresponding to the measured pressure drop $\Delta p_rail_{TEST}$ in the common rail, for the predetermined reference duration $Ti_{REF}$, is representative of the initial or manufactured play of the actuator by comparison with the corresponding parameter $Tcha_{ECU}$ recorded in the engine control unit and corresponding to the same specified pressure drop $\Delta p_rail_{TEST}$ recorded in the engine control unit for the same injector in its initial or factory-new condition.

As shown in the example of FIG. 2, step 200 of measuring the duration $Tcha_{MES}$ of the application time of a specified electric current to the terminals of the piezoelectric actuator, defining a weak electrical charge corresponding to a specified test variation $\Delta p_rail_{TEST}$ of the pressure of the fuel contained in a common injection rail of the engine, corresponding to the predetermined reference duration $Ti_{REF}$, advantageously comprises the following steps:

Choosing a test pressure variation $\Delta p_rail_{TEST}$ of the fuel contained in a common injection rail of the engine, corresponding to a specified duration $Tcha_{ECU}$ of an application time of a specified electric current at the terminals of the piezoelectric actuator to provide a weak test charge at the terminals of the actuator, defining the predetermined reference duration of electrical activation $Ti_{REF}$ of the injector, in such a way that a fuel leak is established from the common rail through the injector toward the tank return line without the opening of the injector needle, Applying a weak electrical charge to the terminals of the piezoelectric actuator, in such a way that a fuel leak is established from the common rail through the injector toward the tank return line without the opening of the injector needle, Maintaining this charge during the duration of electrical activation $Ti_{REF}$ so as to obtain a measurement of the pressure variation $\Delta p_rail_{MES}$, Comparing the measurement of the pressure variation $\Delta p_rail_{MES}$ obtained with the chosen test pressure variation $\Delta p_rail_{TEST}$ of the fuel contained in a common injection rail, Repeating the preceding three steps while modifying the duration Tcha of the application time of an electrical pulse to the piezoelectric actuator, until the measured pressure variation $\Delta p_rail_{MES}$ is equal to the test pressure variation $\Delta p_rail_{TEST}$, and measuring the duration $Tcha_{MES}$ of the application time of an electrical pulse to the piezoelectric actuator for which the measured pressure variation $\Delta p_rail_{MES}$ is equal to the test pressure variation $\Delta p_rail_{TEST}$.

The test pressure drop $\Delta p_rail_{TEST}$ of the fuel in the rail is to be specified in accordance with the tested injector, so as to obtain the operating condition of the injector stated above (movement of the poppet without opening the needle). This test pressure drop $\Delta p_rail_{TEST}$ is recorded in the engine control unit with the duration $Tcha_{ECU}$ of the establishment of the corresponding charge applied to the factory-new piezoelectric actuator to obtain this pressure drop corresponding to the reference duration $Ti_{REF}$ of electrical activation of the injector. It is also possible to record the pressure gradient $grad_{ECU}$ defined by $\Delta p_rail_{TEST}/Ti_{REF}$, as shown in FIG. 2 in step 204.

In step 200, the engine control unit will attempt, in successive commands or iterations of test actuation carried out on the piezoelectric actuator of an injector, to measure the period $Tcha_{MES}$ for establishment of the charge required to obtain the test pressure drop $\Delta p_rail_{TEST}$ for the predetermined duration $Ti_{REF}$, or more precisely, in the example, the pressure gradient $grad_{ECU}$, as explained below. For this purpose, the rail pressure drop $\Delta p_rail_{MES}$ is measured in a loop on each iteration of application of a value Tcha until it is equal to $\Delta p_rail_{TEST}$, or alternatively until the pressure gradient $grad_{MES}$ is equal to the pressure gradient $grad_{ECU}$ recorded in the engine control unit.

By way of example, the test pressure variation of the fuel in the rail is, for example, about 10 bar, and the electrical charge applied to the piezoelectric actuator is such that the voltage at its terminals is about 50 volts for example, the duration $Ti_{REF}$ being in the range from 3 to 5 milliseconds, for example 3 milliseconds.

As shown in FIG. 2, the step 200 comprises, for example, the following steps:

Step 201: Measuring the fuel pressure p_rail, in the common rail before applying a test command for actuating the injector, Step 202: Actuating the piezoelectric actuator of the injector, using a weak electrical charge followed by an electrical discharge at the end of the period $Ti_{REF}$ so as to reclose the poppet, in such a way that a fuel leak is established from the rail through the injector toward the tank return circuit without the opening of the injector needle; record the duration of application $Tcha_{TEST}$ of the specified electric current to the terminals of the actuator resulting in said weak electrical test charge and defining the measured parameter $Tcha_{MES}$, Step 203: Measuring the rail pressure $p_rail_2$ after removing the specified weak electrical test charge, Step 204: Determining the pressure variation $\Delta p_rail_{MES}$ from the difference in the pressures measured before and after the application and removal of the specified weak electrical test charge, in such a way that $\Delta p_rail_{MES}=p_rail_1-p_rail_2$; then relate this pressure variation $\Delta p_rail_{MES}$ to the predetermined reference duration $Ti_{REF}$ to find the pressure gradient $grad_{MES}$, Step 205: Comparing the gradient $grad_{MES}$ with the recorded gradient $grad_{ECU}$, Step 206: If $grad_{MES}$ is different from $grad_{ECU}$, repeating the steps from step 201 until $grad_{MES}=grad_{ECU}$, Step 207: If $grad_{MES}=grad_{ECU}$, going to step 300 for comparing $Tcha_{MES}$ measured for this value of $grad_{MES}$ with $Tcha_{ECU}$ as recorded in the engine control unit, corresponding to the initial factory-new injector, as explained below.

The fuel pressure in the common rail is measured in a known way, using a fuel pressure sensor installed in the common rail, required for the normal operation of the engine control unit.

One solution for adapting the present invention to existing vehicles may be to use part of a first drift correction function for a piezoelectric injector, where this function is already present in the engine control unit; this is the case for some vehicles. This first correction function provides, notably, a picture of the injector play present between the piezoelectric actuator and the poppet on which it acts to open or close the injector. This first correction function uses a tool in the form of a curve establishing a one-to-one relationship between a quantity of fuel passing through the injector and generating a pressure drop in the rail and a corresponding period of electrical charge applied to the piezoelectric actuator of the injector concerned, for a factory-new injector. This first function consists, notably, in applying a voltage pulse to the actuator during a specified period, in the form of the application of a specified electrical charge which causes the opening of the poppet without opening the injector and therefore without injecting fuel into the combustion chamber, and creates a pressure drop in the rail by ejecting from the rail a quantity of fuel which leaves the rail and passes through the injector to return to the fuel tank. This pressure drop is measured and is assigned to the duration of application of the voltage pulse. Thus it is possible to determine a curve of the gradient of the rail pressure drop as a function of the duration of the establishment of the charge $Tcha_{mes}$ applied to the piezoelectric actuator of the injector. The initial (factory) pressure drops for respective given durations of electrical charges are known as a result of the preliminary calibration of the injection system. This part of the first correction function thus compares the pressure drops measured by application of the first correction function with those recorded in the memory of the engine control unit (the factory-new values), which are indicative of the normal or original operation of the injector. It is this part of the first function that can advantageously be used for the application of the present invention. For example, if the measured pressure drop is smaller than that recorded for a given duration of electrical test charge, this means (after the correct operation of the fuel injection pump has been checked) that the quantity of fuel injected during the test pulse has decreased, that the opening period of the injector has therefore also decreased, and that the actuator play has therefore increased, essentially indicating a drift of the injector or, more precisely, depolarization of its piezoelectric actuator. According to the present invention, this part of the first correction function would also enable the same comparison to be used to detect a larger pressure drop in the rail, essentially indicating a reduction in the actuator play for a longer opening time. The curve of the rail pressure drop as a function of the duration of the electrical charge applied to the actuator of the injector thus indicates, by an inverse one-to-one relationship, the duration of the electrical charge to be applied to the piezoelectric actuator in order to obtain the correct pressure drop in the rail and therefore the correct quantity of fuel ejected from the rail. This first correction function therefore makes it possible, when used in full, to correct the drift of the piezoelectric actuator by the action of increasing the duration of the electrical charge applied to the piezoelectric actuator. If the play of the actuator play increases because of the progressive depolarization of the piezoelectric actuator, the first correction function sends an instruction to the electronic control system of the injector to command a longer opening of the injector and thus to compensate for the depolarization, indicated by an opening of the injector for a shorter period because of the shortening of the actuator.

According to the invention, only the part of this first correction function which determines the actual test quantity of fuel leaving the rail as a result of the injector actuation test command is used to control the application of the polarization charge, for example in order to advantageously maintain, cancel or modulate the application of the polarization charge, and of the polarization discharge in the case of maintenance or modulation of the charge.

The modulation of application of the polarization charge/discharge according to the invention may advantageously be provided by a number of methods, for example in the following way:

- Increasing/decreasing the interval of application of the polarization charges during the engine cycles. For example, by not applying the polarization charge continuously to all the engine cycles, but by applying, for example, the polarization charge in one of every two engine cycles, the frequency of application of the polarization charge being defined according to the requirements for readjustment of the polarization of the piezoelectric actuator;
- Increasing/decreasing the voltage Up reached by increasing/decreasing the period of the polarization charge, in other words the period corresponding to the length of the base of the triangle Qp in FIG. 4*b*, which is measured from the instant $t_5$; for example from one engine cycle to another,
- Increasing/decreasing the duration of maintenance of the polarization charge, in other words the period elapsing between the end of the polarization charge and the start of the polarization discharge, depending on the possibilities, from one engine cycle to another.

In fact, according to the invention, this first correction function could lose its original usefulness, as the present invention makes it possible to prevent depolarization of the actuator and therefore to prevent the drift of the injector. However, it may be useful to have this first correction function in the engine control unit in order to improve conformity with the quantities of fuel injected, if it is desired to use the method for controlling the injectors according to the invention while accepting a slight drift of the injectors. The test of the actual quantity of fuel injected and the application of this first correction function, if necessary, may be carried out on all the injectors of the engine.

With reference to FIG. 2, the next step 300 of comparing $Tcha_{MES}$, for the value of $grad_{MES}$, with $Tcha_{ECU}$ corresponding to $grad_{ECU}$ as recorded in the engine control unit for the initial factory-new injector, is preferably composed of the following actions:

- Step 400: The measured period $Tcha_{MES}$ is greater than the period $Tcha_{ECU}$ recorded in the engine control unit, or
- Step 500: The measured period $Tcha_{MES}$ is smaller than or equal to the period $Tcha_{ECU}$ recorded in the engine control unit.

In the first case (step 400 in FIG. 2), this means that the actuator play has increased relative to the corresponding nominal play set by the manufacturer, and that the piezoelectric actuator is therefore becoming depolarized.

In the second case (step 500 in FIG. 2), this means that the actuator play has decreased and that the piezoelectric actuator is therefore becoming polarized beyond the polarization value set by the manufacturer, as a result of the default application of a polarization charge Qp (step 100 in FIG. 2). Consequently, in this case, the application of the polarization charge Qp as defined above should be inactivated or kept inactive or modulated (step 600 in FIG. 2) at least until there is a return to the nominal dimension of the actuator play, as evaluated by a charging time $Tcha_{MES}$ equal or substantially equal to $Tcha_{ECU}$. When the polarization charge Qp has been made inactive or kept inactivated, the method according to the invention returns to step 201 to repeat the steps described above; as long as the value $Tcha_{MES}$ remains smaller than or equal to the corresponding value $Tcha_{ECU}$, the method consists in looping tests for verifying the fuel pressure variation in the common rail, according to steps 201, 202, 203, 204, 205, 206, 207, and 300.

The adjustment of the polarization charge on the basis of the measurement of the pressure variation in the common fuel rail, as described above, is preferable, as it directly indicates the play of the piezoelectric actuator which is the parameter sensitive to the drift (depolarization) of the actuator acting on the length of the actuator, and therefore on the play via the chain of dimensions of the mechanical parts connected to this play.

Figure 3:
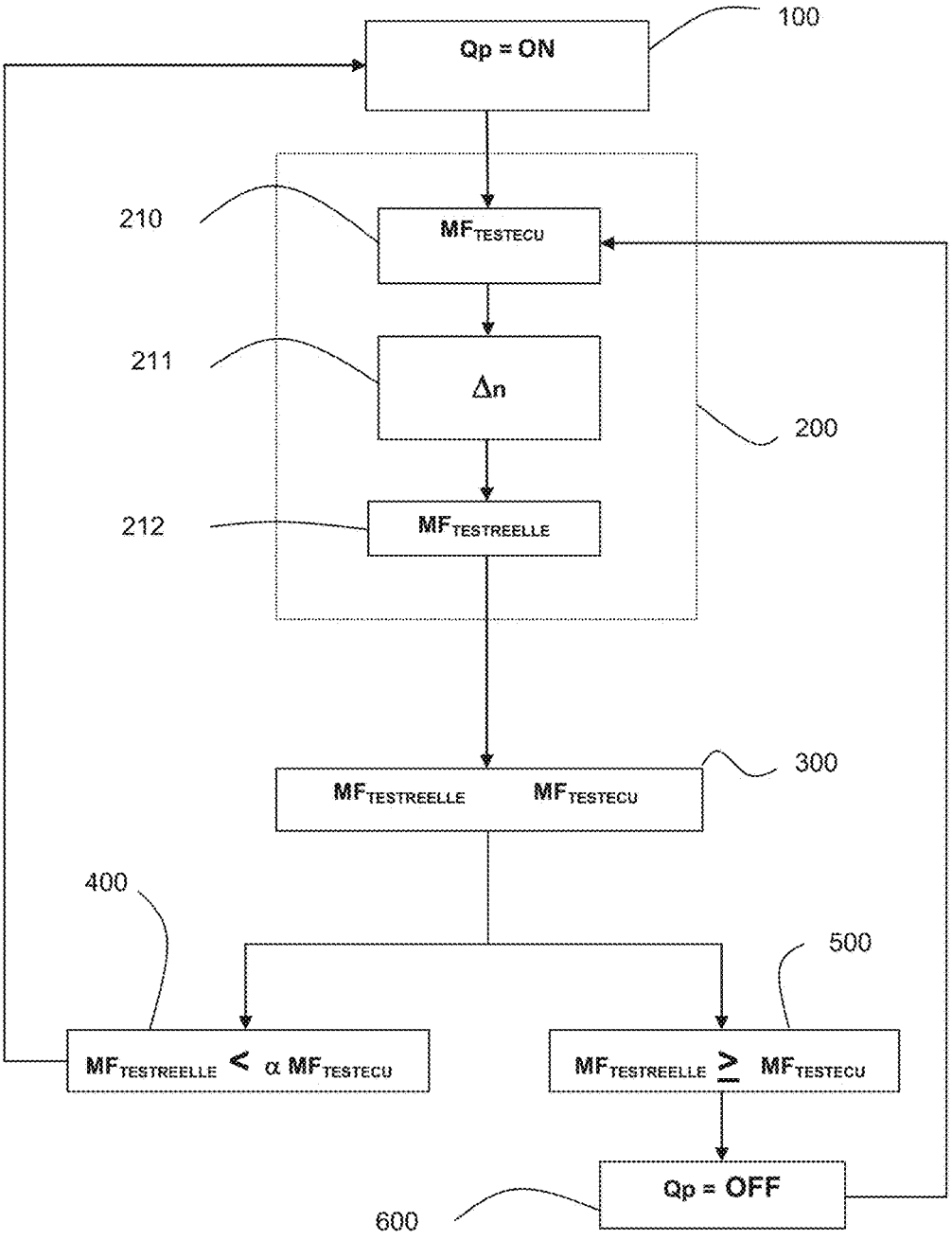
FIG. 3 shows a flow diagram of the method for controlling a fuel injector according to FIG. 1, according to a second example of the engine parameter representative of an actual play between the piezoelectric actuator and the valve means of the injector.

As shown in FIG. 3, the first estimated engine parameter $Pj_{EST}$ according to step 200, representative of an actual play $J_{REEL}$ between the piezoelectric actuator and the valve means, may, alternatively or in addition to the above example, be a test quantity of fuel injected by the injector into the combustion chamber, preferably around the compression top dead center, during the combustion expansion phase. The steps of estimating 200 and comparing 300 the first engine parameter $Pj_{EST}$ then comprise the following steps according to FIG. 3:

- Step 210: Commanding the injection of said test quantity of fuel $MF_{TESTECU}$, predetermined by the engine control unit, into the combustion chamber, in order to monitor the actual test quantity of fuel injected in response to this command,
- Step 211: Measuring a second engine parameter, representative of the actual test quantity of fuel $MF_{TESTREELLE}$ injected in response to the command for the injection of the predetermined test quantity of fuel $MF_{TESTECU}$, as explained below,
- Step 212: Determining, on the basis of the measured second engine parameter, the actual test quantity of fuel $MF_{TESTREELLE}$ injected in response to the command for the injection of the predetermined test quantity of fuel $MF_{TESTECU}$,
- Step 300: Comparing the actual test quantity of fuel $MF_{TESTREELLE}$ with the test quantity of fuel $MF_{TESTECU}$ predetermined by the engine control unit, as follows:
  - Step 400: If the actual test quantity of fuel $MF_{TESTREELLE}$ is smaller than the test quantity of fuel $MF_{TESTECU}$ predetermined by the engine control unit, preferably multiplied by a correction factor α, then, as shown in FIGS. 4*a* and 4*b*:
    - applying a first nominal electrical charge Qc to the piezoelectric actuator, this charge being required to open the injector, and being referred to as the nominal command charge Qc, on the basis of the torque requested and the engine speed, in order to open the valve means of the injector to inject fuel into the combustion chamber to meet the torque request,
    - applying to the piezoelectric actuator, on top of said nominal command charge Qc, after the application of the charge Qc and before the step of commanding a closure of the injector, at least a second electrical charge Qp, called the polarization charge Qp, which is additional to the nominal command charge Qc, in order to polarize the piezoelectric actuator during an opening phase of the injector and during the injection of the fuel into the combustion chamber to meet the torque request, commanding the closure of the injector so as to stop the fuel injection, by applying at least one electrical discharge Qd to the piezoelectric actuator in order to close the valve means, Step 500: If the actual test quantity of fuel $MF_{TESTREELLE}$ is greater than or equal to the test quantity of fuel $MF_{TESTECU}$ predetermined by the engine control unit, not applying the second electrical charge Qp, called the polarization charge Qp, to the piezoelectric actuator of the injector, according to step 600 of FIG. 3.

With reference to the example of FIG. 3, step 210 of commanding the injection of a test quantity of fuel $MF_{TESTECU}$, predetermined by the engine control unit, into the combustion chamber, in order to monitor the actual test quantity of fuel $MF_{TESTREELLE}$ injected in response to this command will now be described. This step 210 consists in injecting a given test quantity of fuel, determined by the engine control unit, at the moment when this has the smallest adverse effect on the operation of the vehicle, for example during deceleration or slowing. The engine control unit commands the injection of this given test quantity of fuel $MF_{TESTECU}$ by sending a test electrical charge to the tested injector, corresponding to a period of opening of the injector determined on the basis of the pressure of the rail where the injection takes place. These data, relating to a specific injector and a specific engine, are mapped and stored in the engine control unit.

The second engine parameter, measured in step 211 of this example, representative of the actual test quantity of fuel $MF_{TESTREELLE}$ injected in response to the command for the injection of the predetermined test quantity of fuel $MF_{TESTECU}$, is the variation Δn of the engine speed.

With reference to FIG. 3, the next step 212 consists in determining, on the basis of the representative second engine parameter Δn measured in step 211, the actual test quantity of fuel $MF_{TESTREELLE}$ injected in response to the command for the injection of the predetermined test quantity of fuel $MF_{TESTECU}$.

Step 212 of determining the actual test quantity of fuel injected $MF_{TESTREELLE}$, using the representative second engine parameter in this example, corresponding to the variation Δn of engine speed, will now be described: the engine speed is measured in a known way by measuring the time elapsing between two specified positions of the crankshaft. The speed is deduced from this time because there is a known distance between said two given positions, and the acceleration or variation of the crankshaft speed is then found by derivation from the speed, enabling the engine torque to be determined if necessary. A correspondence table between the crankshaft accelerations/torques and the corresponding test quantities of fuel injected is drawn up for a given new engine, and the comparison step 300 is executed on the basis of this. To find the variation of the engine torque or acceleration caused by the injection of the actual quantity of fuel $MF_{TESTREELLE}$, the time between two specified positions of the crankshaft is measured, these positions being, respectively, before and after the actual test quantity of fuel $MF_{TESTREELLE}$ injected in response to the command predetermined by the engine control unit. The speed and acceleration of the engine are measured by means of the crankshaft position sensor, a chronometer, and a computer already present in the engine control unit, this procedure being known to persons skilled in the art.

This method of determining an injected quantity of fuel according to a variation in engine speed caused in the crankshaft is known to those skilled in the art and will not be detailed further here. One solution for adapting the present embodiment of the present invention to existing vehicles may be to use a second drift correction function for a piezoelectric injector, where this function is already present in the engine control unit; this is the case for some vehicles. This second correction function consists in injecting, in the deceleration phase of the engine (no load) for example, a small specified quantity of fuel, or "test injection", and monitoring the results of this injection by means of the crankshaft position sensor, according to which the increase in torque due to the injection is determined. By integrating the deformation in the engine speed curve due to the test injection, it is possible to discover the test quantity of fuel actually injected, the second correction function then consisting in comparing this test quantity actually injected with the setpoint quantity commanded by the engine control unit. The learning provided by this second correction function consists in defining the new operating curve of the injector corresponding to actual test quantities of fuel injected as a function of times of electrical pulses applied to the injector. This new curve shows the variations in the quantities of fuel injected for a given electrical pulse time, with the corresponding factory curve, or conversely the variations in the pulse times required for the injector to inject a given quantity of fuel. Additionally, this second correction function does not exclusively take into account the drift of the injectors or the drift of the piezoelectric actuators, since it uses the torque or acceleration of the engine. It must therefore be made to determine, by learning, a curve of the actual quantities of fuel delivered by the injector as a function of the electrical pulse times applied; in the context of the application of this second correction function, if the test quantity of fuel injected is found to be smaller than the setpoint test quantity of fuel found from the nominal learning reference curve of the second correction function, this second adaptive function consists in correcting the drift of the injector by increasing the opening time of the injector to adjust the quantity of fuel injected with respect to the nominal learning reference curve of the second correction function. As in the case of the first correction function described above, according to the invention, it would be possible to use only the part of this second correction function which determines the actual quantity of fuel injected for test purposes, in order to inactivate, or not to inactivate, the polarization charge of the actuator. However, according to the invention, and as in the case of the first correction function, it may be useful to have the second correction function in the engine control unit in order to improve conformity with the quantities of fuel injected, if it is desired to use the method for controlling the injectors according to the invention while accepting a slight drift of the injectors. Clearly, the test of the actual quantity of fuel injected and the application of the second correction function, if necessary, may be carried out on all the injectors of the engine.

With reference to FIG. 3, the next step 300 consists in comparing the actual test quantity of fuel injected $MF_{TESTREELLE}$ with the test quantity of fuel $MF_{TESTECU}$ predetermined by the engine control unit. Two cases are distinguished, as shown in FIG. 3:

Step 400: The actual test quantity of fuel injected $MF_{TESTREELLE}$ is smaller than the quantity of fuel $MF_{TESTECU}$ predetermined by the engine control unit, multiplied by a correction factor $\alpha$, or Step 500: The actual test quantity of fuel injected $MF_{TESTREELLE}$ is greater than or equal to the quantity of fuel $MF_{TESTECU}$ predetermined by the engine control unit.

In the first case (box 400 in FIG. 3), this means that the actuator play has increased relative to the nominal play set by the manufacturer, and that the piezoelectric actuator is therefore becoming depolarized. A correction factor $\alpha$, in the range from 0.9 to 0.8 for example, is preferably applied so that the polarization charge only has to be applied in case of a fault attributable to the depolarization. This correction factor $\alpha$ is determined according to each injector and on the basis of the manufacturer's data.

In the second case (box 500 in FIG. 3), this means that the actuator play has decreased and that the piezoelectric actuator is therefore becoming polarized beyond the polarization value set by the manufacturer, as a result of the default application of a polarization charge Qp (step 100 in FIG. 2). Consequently, in this case, the application of the polarization charge Qp as defined above must be inactivated or kept inactive (step 600 in FIG. 3) at least until there is a return to the nominal dimension of the actuator play, as evaluated by an actual test quantity of fuel injected $MF_{TESTREELLE}$ corresponding substantially or exactly to the predetermined test quantity of fuel $MF_{TESTECU}$ commanded by the engine control unit according to step 210 of FIG. 3. When the polarization charge Qp has been made inactive, the method according to the invention returns to step 210 to repeat the steps described above; as long as the value $MF_{TESTREELLE}$ remains smaller than or equal to the corresponding value $MF_{TESTECU}$, the method consists in looping tests for verifying the test quantity of fuel injected, according to steps 210, 211, 212, and 300.

The method for controlling a fuel injector described above, according to the invention, may be implemented in the engine control unit and coupled, if appropriate, to one or other of the two functions for correcting the drift of the injectors described above. The method for controlling a fuel injector described above, according to the invention, may advantageously be coupled to both functions if they are present. This is because the first correction function compensates for the upper part of an injector, which is essentially the play created by the piezoelectric actuator and the question of its depolarization. As regards the second function, this compensates for all the plays of an injector, in other words the upper and lower parts of the injector. By coupling the method described above to the second function as an alternative to, or in addition to, the first function, the application of the polarization charge according to the invention takes into account all the plays of the injector, and provides a correction of all of these plays by the polarization of the actuator, subject to a certain limit as explained above, consisting in retaining a minimum play of the actuator. Thus, in the absence of the first correction function, it is evident that the application of the polarization charge according to the invention is less directed toward the actual depolarization of the actuator.

This method for controlling a fuel injector described above, according to the invention, thus enables the play of the actuator to be adjusted around the nominal value of play given by the manufacturer of the injection system, during the operation of the engine, and thus makes it possible to avoid or control the drift of this play, and therefore the drift of the quantities of fuel injected.

The method of controlling a fuel injector described above, according to the invention, may advantageously be applied continuously from the starting of the vehicle onward, for the purpose of monitoring the variation of the actuator play as described, and in order to determine whether specific strategies of the method for controlling the piezoelectric actuator as described above, by modulation of the polarization charge as also described above, could be applied and implemented in accordance with the use of the vehicle. For example, the method for controlling the piezoelectric actuator may provide for the application of the maximum polarization charge, according to the application time of the polarization charge optimized according to the available time, if it is found that the continuous application of a given polarization voltage Up is insufficient to counteract the depolarization of the injectors. Conversely, if the continuous application of a given polarization voltage leads to a decrease in the play of the actuator, the polarization voltage Up may be reduced or applied in a non-continuous manner, as explained above.

The invention claimed is:

1. A method for controlling a fuel injector of an internal combustion engine of a vehicle, said injector comprising a piezoelectric actuator acting on a valve to open or close said injector, thereby respectively enabling or preventing the injection of fuel into a combustion chamber of the engine, said vehicle comprising an on-board engine control unit for executing said control method, said valve comprising a poppet actuated directly by the piezoelectric actuator and an associated needle actuated by its contact with the high pressure in the rail, said poppet, when open, allowing the high pressure from an injection rail to communicate with the low pressure of the return circuit leading to the fuel tank, said control method comprising the following steps, in the normal operation of the vehicle:

estimating a first engine parameter, representative of an actual play between the piezoelectric actuator and the valve including the poppet actuated directly by the piezoelectric actuator and the associated needle actuated by its contact with the high pressure in the rail;

comparing said estimated first engine parameter with the equivalent parameter representative of the original play between the piezoelectric actuator and the valve, as previously recorded in the engine control unit;

when said estimated first engine parameter differs from said equivalent parameter representative of said original play such that said actual play is greater than said original play:

applying a first nominal electrical charge to the piezoelectric actuator, the first nominal electrical charge being required to open the injector, the first nominal electrical charge being a nominal command charge, based on the torque requested and the engine speed, in order to open the valve of the injector to inject fuel into the combustion chamber, applying to the piezoelectric actuator, in addition to the nominal command charge, after the application of the nominal command charge and before the step of commanding a closure of the injector, at least a second electrical charge or polarization charge, which is additional to the nominal command charge, in order to polarize the piezoelectric actuator during an opening phase of the injector and during the injection of the fuel into the combustion chamber, and commanding the closure of the injector to stop the fuel injection, by applying at least one electrical discharge to the piezoelectric actuator in order to close the valve; and when said estimated first engine parameter differs from said equivalent parameter representative of said original play such that said actual play is smaller than or equal to said original play, not applying said second electrical charge that is the polarization charge, to the piezoelectric actuator of said injector.

2. The control method as claimed in claim 1, wherein the estimating the first engine parameter representative of the actual play between the piezoelectric actuator and the valve comprises measuring a duration of application time of a weak electrical pulse to the piezoelectric actuator, the weak electrical pulse corresponding to a specified test variation in the pressure of the fuel contained in a common injection rail of said engine, for a predetermined reference duration of electrical activation of the injector.

3. The control method as claimed in claim 2, wherein the step of measuring the duration of the application time of the weak electrical pulse to the piezoelectric actuator, the pulse corresponding to a specified test variation in the pressure of the fuel contained in the common injection rail of said engine, for the predetermined reference period of electrical activation of the injector, comprises the following steps:

choosing a test pressure variation of the fuel contained in the common injection rail of the engine, corresponding to a specified duration of an application time of a specified electric current at the terminals of the piezoelectric actuator to provide a weak test charge at the terminals of the actuator, defining the predetermined reference duration of electrical activation of the injector, such that a fuel leak is established from the common rail through the injector toward the tank return line without the opening of the injector needle, applying a weak electrical charge to the terminals of the piezoelectric actuator, such that a fuel leak is established from the common rail through the injector toward the tank return line without the opening of the injector needle, maintaining the weak electrical charge during said duration of electrical activation to obtain a measurement of the pressure variation in the common injection rail, comparing said measurement of the pressure variation obtained with said chosen test pressure variation of the fuel contained in a common injection rail, and repeating the preceding three steps while modifying the duration of the application time of an electrical pulse to the piezoelectric actuator, until said measured pressure variation is equal to said test pressure variation, and measuring the duration of the application time of an electrical pulse to the piezoelectric actuator for which the measured pressure variation is equal to the test pressure variation.

4. The method for controlling a fuel injector as claimed in claim 1, wherein the estimating the first engine parameter comprises estimating a test quantity of fuel actually injected by the injector into the combustion chamber in response to a command for the injection of a test quantity of fuel, predetermined by the engine control unit, into said combustion chamber.

5. The method for controlling a fuel injector as claimed in claim 4, wherein the step of estimating said test quantity of fuel actually injected by the injector into the combustion chamber comprises the following steps:

commanding the injection of said test quantity of fuel, predetermined by the engine control unit, into said combustion chamber, in order to monitor the actual test quantity of fuel injected in response to said command, measuring a second engine parameter, representative of the actual test quantity of fuel injected in response to said command for the injection of said predetermined test quantity of fuel, and determining, on the basis of said measured second parameter, said actual test quantity of fuel injected in response to said command for the injection of said predetermined test quantity of fuel.

6. The control method as claimed in claim 5, wherein said step of measuring a second engine parameter, representative of the actual test quantity of fuel injected in response to said command for the injection of a test quantity of fuel predetermined by the engine control unit, comprises measuring the engine speed before and after the injection of the actual test quantity of fuel injected in response to said command for the injection of a test quantity of fuel predetermined by the engine control unit, to obtain the variation of engine speed or engine torque resulting from the injection of the actual quantity of fuel.

7. The control method as claimed in claim 6, wherein said variation of the engine speed is measured by a crankshaft position sensor.

8. The control method as claimed in claim 4, wherein said quantity of fuel predetermined by the engine control unit, the injection of which into said combustion chamber is commanded for the purpose of monitoring the actual quantity of fuel injected, is defined based on a correspondence table between the periods of maintenance of electrical charges applied to the injector and the corresponding quantities of fuel injected, as a function of a range of fuel pressure in a common injection rail.

9. The control method as claimed in claim 4, wherein the step of comparing the actual test quantity of fuel injected with the test quantity of fuel predetermined by the engine control unit comprises the application of a correction factor.

10. The control method as claimed in claim 5, wherein said quantity of fuel predetermined by the engine control unit, the injection of which into said combustion chamber is commanded for the purpose of monitoring the actual quantity of fuel injected, is defined based on a correspondence table between the periods of maintenance of electrical charges applied to the injector and the corresponding quantities of fuel injected, as a function of a range of fuel pressure in a common injection rail.

11. The control method as claimed in claim 6, wherein said quantity of fuel predetermined by the engine control unit, the injection of which into said combustion chamber is commanded for the purpose of monitoring the actual quantity of fuel injected, is defined based on a correspondence table between the periods of maintenance of electrical charges applied to the injector and the corresponding quantities of fuel injected, as a function of a range of fuel pressure in a common injection rail.

12. The control method as claimed in claim 7, wherein said quantity of fuel predetermined by the engine control unit, the injection of which into said combustion chamber is commanded for the purpose of monitoring the actual quantity of fuel injected, is defined based on a correspondence table between the periods of maintenance of electrical charges applied to the injector and the corresponding quantities of fuel injected, as a function of a range of fuel pressure in a common injection rail.

13. The control method as claimed in claim 5, wherein the step of comparing the actual test quantity of fuel injected with the test quantity of fuel predetermined by the engine control unit comprises the application of a correction factor.

14. The control method as claimed in claim 6, wherein the step of comparing the actual test quantity of fuel injected with the test quantity of fuel predetermined by the engine control unit comprises the application of a correction factor.

15. The control method as claimed in claim 7, wherein the step of comparing the actual test quantity of fuel injected ($MF_{TESTREELLE}$) with the test quantity of fuel predetermined by the engine control unit comprises the application of a correction factor.

16. The control method as claimed in claim 8, wherein the step of comparing the actual test quantity of fuel injected with the test quantity of fuel predetermined by the engine control unit comprises the application of a correction factor.

* * * * *